US007030304B1

(12) United States Patent
Harris

(10) Patent No.: US 7,030,304 B1
(45) Date of Patent: Apr. 18, 2006

(54) LENTICULAR IMAGE GUITAR TOP

(76) Inventor: Austin Harris, 24610 Town Center Dr., #5201, Valencia, CA (US) 91355

( * ) Notice: Subject to any disclaimer, the term of this patent is extended or adjusted under 35 U.S.C. 154(b) by 30 days.

(21) Appl. No.: 10/750,357

(22) Filed: Dec. 31, 2003

(51) Int. Cl.
*G10D 3/00* (2006.01)

(52) U.S. Cl. ..... 84/290

(58) Field of Classification Search ..... 84/290, 84/267, 291; 359/15, 1, 462–463, 20–23
See application file for complete search history.

(56) References Cited

U.S. PATENT DOCUMENTS

| | | | | |
|---|---|---|---|---|
| 2,305,890 | A | 12/1942 | Moore | |
| 3,251,258 | A | 5/1966 | Parker | |
| 4,073,612 | A | 2/1978 | Nitta | |
| 4,362,079 | A | 12/1982 | Kelly | |
| 4,373,417 | A | 2/1983 | Wilson et al. | |
| 4,601,391 | A | 7/1986 | Gibbs et al. | |
| 5,267,499 | A | 12/1993 | Othon | |
| 5,333,527 | A * | 8/1994 | Janes et al. | 84/291 |
| 5,517,891 | A | 5/1996 | Sica | |
| 5,850,913 | A | 12/1998 | Fantone et al. | |
| 6,262,354 | B1 | 7/2001 | Solomon, Jr. | |
| 6,357,153 | B1 | 3/2002 | Gelardi et al. | |
| 6,422,859 | B1 | 7/2002 | Demetz | |
| 6,549,503 | B1 | 4/2003 | Matos | |
| 6,649,817 | B1 * | 11/2003 | Hartill | 84/267 |

FOREIGN PATENT DOCUMENTS

| | | |
|---|---|---|
| WO | WO02/051611 | 7/2002 |

* cited by examiner

*Primary Examiner*—Kimberly Lockett
(74) *Attorney, Agent, or Firm*—Law Offices of David L. Hoffman

(57) ABSTRACT

The present invention 10 discloses a lenticular layer 22 for a top surface 14 of a solid body guitar 12 comprised of an array of juxtapositioned linear lenses 28 wherein each lens resides over a portion of one or more images 24 that are formed in such a manner that changing the viewing angle of the lenses changes the image. The lenticular top 22 is bonded at 26 to the top surface 14 of the guitar body 12 having apertures or cutouts 16, 18, 20 for the placement of guitar hardware. The present invention 10 forms a permanent lenticular guitar top 22 covering for the front surface 14 of an electric guitar 12 or an electric bass guitar. The lenticular guitar top 22 is installed in place of the common wooden guitar tops typically made from flame maple, curly maple, koa, etc. The lenticular guitar top 22 is permanently bonded at 26 to the body of the guitar 14 using glue or other such bonding material.

9 Claims, 7 Drawing Sheets

LENTICULAR IMAGE GUITAR TOP

BACKGROUND OF THE INVENTION

1. Field of the Invention

The present invention relates generally to musical instruments and, more specifically, to the manufacture of a layer for a the top surface of a solid body guitar comprised of an array of juxtapositioned linear lenses wherein each lens resides over a portion of one or more images that are formed in such a manner that changing the viewing angle of the lenses changes the image. The lenticular top is bonded to the top surface of the guitar body having aperture for the placement of guitar hardware.

The present invention forms a permanent lenticular guitar top covering the front surface of an electric guitar or an electric bass guitar. The lenticular guitar top is installed in place of the common wooden guitar tops typically made from flame maple, curly maple, koa, etc. The lenticular guitar top is permanently bound to the body of the guitar using glue or other such bonding material. The lenticular guitar top gives the guitar a very unique and dynamic appearance because of the various 3-D or multiple flip images available with lenticulars, as well as the unique rigid surface of the lenticular lens itself. The lenticular guitar top covers the entire top surface of the guitar except where cut out to allow for the guitar's hardware such as the bridge, pickup, volume and tone knobs.

2. Description of the Prior Art

There are other materials designed for guitar cases. Typical of these is U.S. Pat. No. 2,305,890 issued to Moore on Dec. 22, 1942.

Another patent was issued to Parker on May 17, 1966 as U.S. Pat. No. 3,251,258. Yet another U.S. Pat. No. 4,073,612 was issued to Nitta on Feb. 14, 1978 and still yet another was issued on Dec. 7, 1982 to Kelly as U.S. Pat. No. 4,362,079.

Another patent was issued to Wilson, et al. on Feb. 15, 1983 as U.S. Pat. No. 4,373,417. Yet another U.S. Pat. No. 4,601,391 was issued to Gibbs, et al. on Jul. 22, 1986. Another was issued to Sica on May 21, 1996 as U.S. Pat. No. 5,517,891 and still yet another was issued on Dec. 7, 1993 to Othon as U.S. Pat. No. 5,267,499.

Another patent was issued to 5,850,913 on Dec. 22, 1998 as U.S. Pat. No. 5,850,913. Yet another U.S. Pat. No. 6,262,354 was issued to Solomon, Jr. on Jul. 17, 2001. Another was issued to Gelardi, et al. on Mar. 19, 2002 as U.S. Pat. No. 6,357,153. Still yet another was issued on Jul. 23, 2002 to Demetz as U.S. Pat. No. 6,422,859. Another patent was issued to Matos on Apr. 15, 2003 as U.S. Pat. No. 6,549,503 and yet another WIPO Publication No. WO 02/051611 was filed by Guest on Jul. 4, 2002.

U.S. Pat. No. 2,305,890

Inventor: J. H. Moore

Issued: Dec. 22, 1942

An article having a pair of spaced, substantially parallel transparent faces, one face constituting a foreground and bearing the representation of an object, said object having its back superimposed against the outer surface of the foreground, and the other face constituting a background and bearing the representation of a different object, said object having its front superimposed against the outer surface of the background, thereby making up a complete picture in stereoscopic relief.

U.S. Pat. No. 3,251,258

Inventor: G. H. Parker

Issued: May 17, 1966

In a stringed instrument protector, a back cover portion of sheet material adapted to fit the back of the body of a stringed instrument, and resilient clamping means secured to the back cover portion and adapted to grip the periphery of the body of the stringed instrument and retain the back cover portion on the back of the body to protect the body from injuries to the finish thereof.

U.S. Pat. No. 4,073,612

Inventor: Tomio Nitta

Issued: Feb. 14, 1978

A disposable cigarette gas lighter employing a plastic gas tank is provided on the face of the gas tank with a printed sheet carrying thereon publicity information. The gas tank is provided with a recess to receive the printed sheet and a plastic lens is attached thereover. Otherwise, the plastic lens is provided on the back surface thereof with a recess to receive the printed sheet. The plastic lens is formed as a cylindrical positive lens.

U.S. Pat. No. 4,362,079

Inventor: Charles J. Kelly

Issued: Dec. 7, 1982

An accentuator plate is mounted in an opening provided for that purpose in the top surface of the hollow body of a vibrating soundboard type of stringed musical instrument. The accentuator plate has an outward, generally convex contour, and it has an inside generally concave contour to provide the accentuator plate with a thin, dome-shaped geometry. The accentuator plate is preferably located adjacent the lowest note string and substantially behind the bridge of the musical instrument. The accentuator plate comprises at least five percent and not more than thirty percent of the total surface area of the top surface of the instrument's body.

U.S. Pat. No. 4,373,417

Inventor: Gregg Wilson

Issued: Feb. 15, 1983

The economy of manufacture of electric guitars and electric bass guitars is improved, with no loss of quality, by providing an anchor flange in integral relationship with a metal pickguard of the guitar or bass guitar. Extended through the anchor flange are adjustment screws which connect adjustably to bridge barrels over which the strings extend. The adjustment screws and bridge barrels are preassembled to the anchor flange, and all electric components are preassembled to the pickguard, prior to mounting of the pickguard on the body of the guitar or bass. Thus, the ultimate in economy is achieved, yet the anchor flange has very strong support from the pickguard and is located accurately thereby.

U.S. Pat. No. 4,601,391

Inventor: Richard Gibbs, et al.

Issued: Jul. 22, 1986

The present invention provides a unique ventilated fabric cover reinforced at selected portions for protecting finishes of stringed instruments. In a presently preferred embodiment, the inventive fabric cover is composed of interlaced, natural fibers woven or knitted in a prescribed ventilated pattern, and reinforced at selective portions which are more subject to wear as the instrument is played over time. The ventilated fabric is configured to protect and surround the outer rear peripheral portion of the stringed instrument, and may be custom sized for a wide variety of guitars, violins, violas, lutes, stringed basses, cellos, or the like. The unique cover further comprises elastic banding disposed in a central portion of the fabric to effect a tensioned form fit with the outer rear peripheral portion of the instrument to be protected. Accordingly, the inventive ventilated fabric cover protects the delicate finish of stringed instruments which are easily scratched or marred, but will not adversely interfere with the acoustic quality of the sound produced by the stringed instrument.

U.S. Pat. No. 5,267,499

Inventor: Robert S. Othon

Issued: Dec. 7, 1993

A method of enhancing and modifying the visual and aural characteristics of a stringed instrument wherein the flat surfaces of a stone and the body of a stringed instrument are adhesively secured together. The stone is worked while the stone is bonded to the instrument to reduce the thickness of the stone and produce a stone laminate.

U.S. Pat. No. 5,517,891

Inventor: Marc V. Sica

Issued: May 21, 1996

The invention is a guitar pick guard, for mounting on a guitar having a guitar body, a neck, and a bridge. The guitar pick guard is mounted to the guitar body between the neck and the bridge. The guitar pick guard has a top layer, a bottom layer and a middle layer. The top layer is made of fabric. The bottom layer is made of a soft felt material. The middle layer is made of a flexible rubber, plastic or vinyl material.

U.S. Pat. No. 5,850,913

Inventor: Stephen D. Fantone, et al.

Issued: Dec. 22, 1998

Optical arrangements are provided by which observers of flat containers or display boxes, such as compact disc (CD) jewel boxes, can be presented with different information about the contents of the box when looking at one of its surfaces from different angular perspectives. Advantageously, parallax effects are compensated where the size of the observable images and the viewing distance create undesirable visual artifacts. Horizontally and vertically oriented lenticulated panels are used in combination with interlaced images to convey the differently coded views without the need for physically manipulating such boxes as in the past to see equivalent information. Compliant inserts preferably provide the information content of the various views and are adapted for use with industry automated insert machinery while being self aligning with the lenticulated panels. These arrangements enhance the possibilities for displaying more and different kinds of information on a given box surface area compared with conventional approaches, and as such, enhance the prospects for increasing initial and multiple sales of CD products.

U.S. Pat. No. 6,252,354

Inventor: Collins Solomon, Jr.

Issued: Jul. 17, 2001

The present invention provides a unique device for protecting the strings of musical instruments such as guitars and stringed bases in the event they should topple over face down. The device also serves to clean and buff the strings of musical instruments while at the same time providing a pocket and for pick storage. The present invention is a pad of soft cloth or pre-formed soft rubber which when attached to the strings of musical instruments will not scratch and damage the instruments delicate finish. A groove bottom side enables a secure fit over and around string 11*a* through 11*f*. It also allows for easy attachment and detachment of pad.

U.S. Pat. No. 6,357,153

Inventor: Tatiana L. Gelardi, et al.

Issued: Mar. 19, 2002

A device for displaying multiple images in an animation-like manner is provided. The device includes an outer shell having a pair of opposed transparent lenticular surfaces and a pair of opposed side walls extending between opposed outer edges of the lenticular surfaces thereby forming a hollow rectangular cavity. The device also includes a generally rectangular slide insertable through an opening in the first end of the cavity. Interleaved images are positioned on the opposed faces of the slide. The device further includes a part for reciprocating the slide in the cavity thereby altering the appearance of the displayed image. The reciprocating part includes a detent slot formed in an interior region of each of the side walls of the outer shell and a corresponding pair of spring bar mounted detent tabs for engaging the detent slots. A spring bar is positioned generally parallel to the second end of the slide and dihedral spring leaves are positioned in a center of the spring bar. The spring bar and the spring leaves bias the slide away from the second end of the outer shell. A push bar extends from the first end of the slide through the opening. The push bar enables the slide to be reciprocated in the outer shell. Pushing the push bar against the force of the spring bar and spring leaves alters the appearance of the displayed image.

U.S. Pat. No. 6,422,859

Inventor: Werner Demetz

Issued: Jul. 23, 2002

A cigarette lighter that includes a lenticular optical indicia display for displaying two or more images on the outside surface of the cigarette lighter body or portions thereof while including an improved non-slip grip.

U.S. Pat. No. 6,549,503

Inventor: Jose R. Matos

Issued: Apr. 15, 2003

The present invention provides a disc player comprising one or more light sources that project a pulsing light onto the upper portion of a disc being played by the disc player. The pulse frequency, pulse length, pulse period, pulse interval, pulse color, pulse intensity or a combination thereof of the light source can be synchronized with the rotation of the spindle in the disc player, with the optical data stored, or with the rotation of an image precursor on the disc. When the disc is viewed through a viewing port while the disc is being played, a two-dimensional or three-dimensional discrete image is formed by the persistence of vision.

WIPO Publication Number WO 02/051611

Inventor: Richard Guest

Issued: Jul. 4, 2002

A method of fabricating plastic products with an integrated Lenticular lens material that thermally protects the ink layer and outer lens surfaces of the Lenticular insert. A Lenticular lens material is provided with a Lenticular lens layer with an outer surface of optical ridges and an ink layer bonded to a transparent lens layer. A thermal protective substrate comprising opaque flexographic ink is applied to the ink layer. The application of the thermal protective substrate is completed using a coating unit of a lithographic press. A Lenticular insert is formed from the coated Lenticular lens material and the insert is positioned within a mold cavity. The thermal protective substrate insulates the ink layer. Concurrently, the portion of the mold adjacent the insert is cooled to a temperature below the deformation temperature of the optical ridges. While these devices may be suitable for the purposes for which they were designed, they would not be as suitable for the purposes of the present invention, as hereinafter described.

SUMMARY OF THE PRESENT INVENTION

The present invention discloses a lenticular layer for a top surface of a solid body guitar comprised of an array of juxtapositioned linear lenses wherein each lens resides over a portion of one or more images that are formed in such a manner that changing the viewing angle of the lenses changes the image. The lenticular top is bonded to the top surface of the guitar body having apertures or cutouts for the placement of guitar hardware. The present invention forms a permanent lenticular guitar top covering for the front surface of an electric guitar or an electric bass guitar. The lenticular guitar top is installed in place of the common wooden guitar tops typically made from flame maple, curly maple, koa, etc. The lenticular guitar top is permanently bonded to the body of the guitar using glue or other such bonding material.

A primary object of the present invention is to provide a new and novel solid body guitar top.

Another object of the present invention is to provide a guitar top comprised of an array of lenses having one or more images positioned thereunder.

Yet another object of the present invention is to provide a guitar top wherein said image is fabricated whereby viewing said images through said lenses in one viewing angle depicts one image while changing the viewing angle depicts an alternate image.

Still yet another object of the present invention is to provide a guitar top wherein said lenses and said images form a device commonly referred to as a lenticular.

Another object of the present invention is to provide a guitar top comprised of a lenticular wherein said image(s) can be formed of any image, picture, illustration, painting, graphic or indicia.

Yet another object of the present invention is to provide a guitar top wherein said lenticular conforms to the surface area of the guitar top.

Still yet another object of the present invention is to provide a guitar top wherein said lenticular is fixedly attached to said guitar top by means such as bonding.

Additional objects of the present invention will appear as the description proceeds.

The present invention overcomes the shortcomings of the prior art by providing a permanent lenticular guitar top covering the front surface of an electric guitar or an electric bass guitar. The lenticular guitar top is installed in place of the common wooden guitar tops typically made from flame maple, curly maple, koa, etc. The lenticular guitar top is permanently bound to the body of the guitar using glue or other such bonding material. The lenticular guitar top gives the guitar a very unique and dynamic appearance because of the various 3-D or multiple flip images available with lenticulars, as well as the unique rigid surface of the lenticular lens itself. The lenticular guitar top covers the entire top surface of the guitar except where cut out to allow for the guitar's hardware such as the bridge, pickup, volume and tone knobs.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
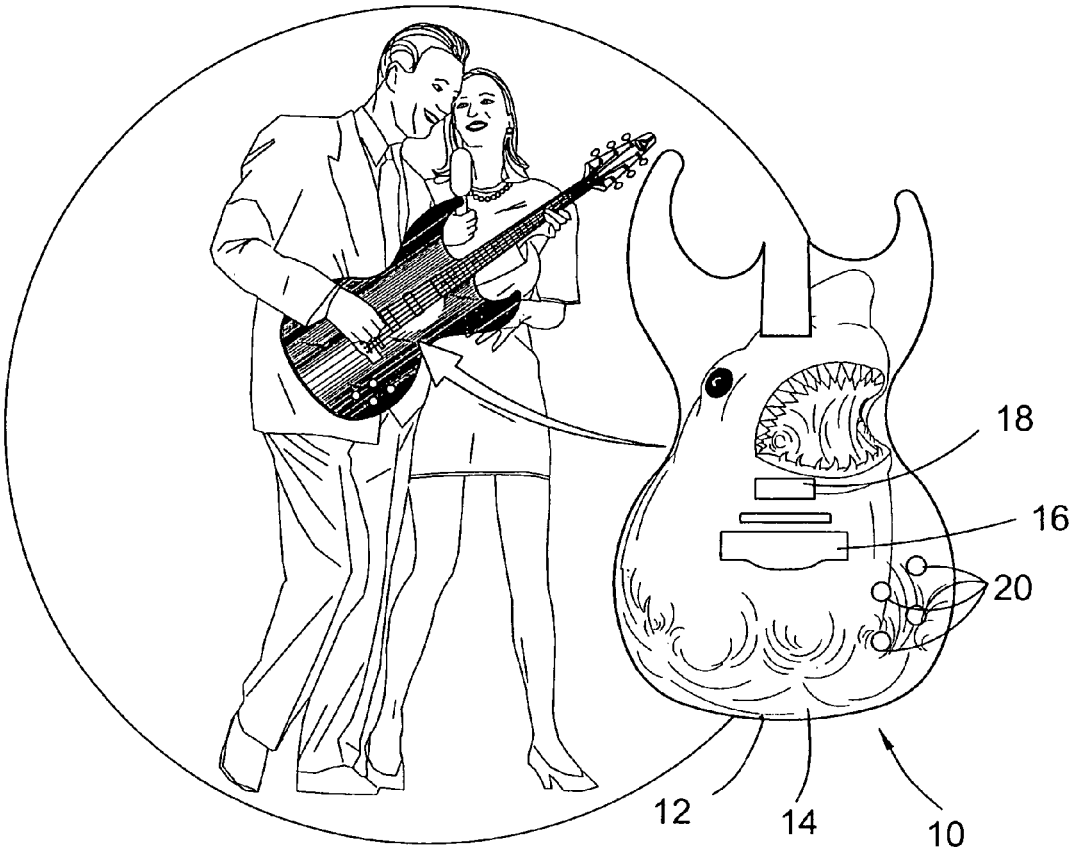
FIG. 1 is an illustrative view of the present invention in use.

With regard to reference numerals used, the following numbering is used throughout the drawings.

10 present invention
12 guitar
14 top of guitar
16 bridge cutout
18 pickup cutout
20 control knob cutout
22 lenticular top
24 lenticular image
26 bonding layer
28 lenticular lenses

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to appended claims.

Turning to FIG. 1, shown therein is an illustrative view of the present invention 10 in use. The present invention 10 comprises a permanent lenticular guitar 12 top 14 installed by the manufacturer covering the front surface of an electric guitar 14 or an electric bass guitar. This lenticular guitar top 10 is installed by the manufacturer in place of the common wooden guitar tops typically made from flame maple, curly maple, koa, etc. The lenticular guitar top 10 is permanently bound to the body of the guitar 12 by the manufacturer with glue or other such bonding material. The lenticular guitar top 10 gives the guitar 12 a very unique and dynamic appearance because of the various 3D or multiple flip images available with lenticulars, as well as the unique rigid surface of the lenticular lens itself. The lenticular guitar top 10 covers the entire top surface 14 of the guitar 12 except where cut out to allow for the guitar's hardware such as the bridge 16, pickup 18, volume and tone knobs 20.

Figure 2:
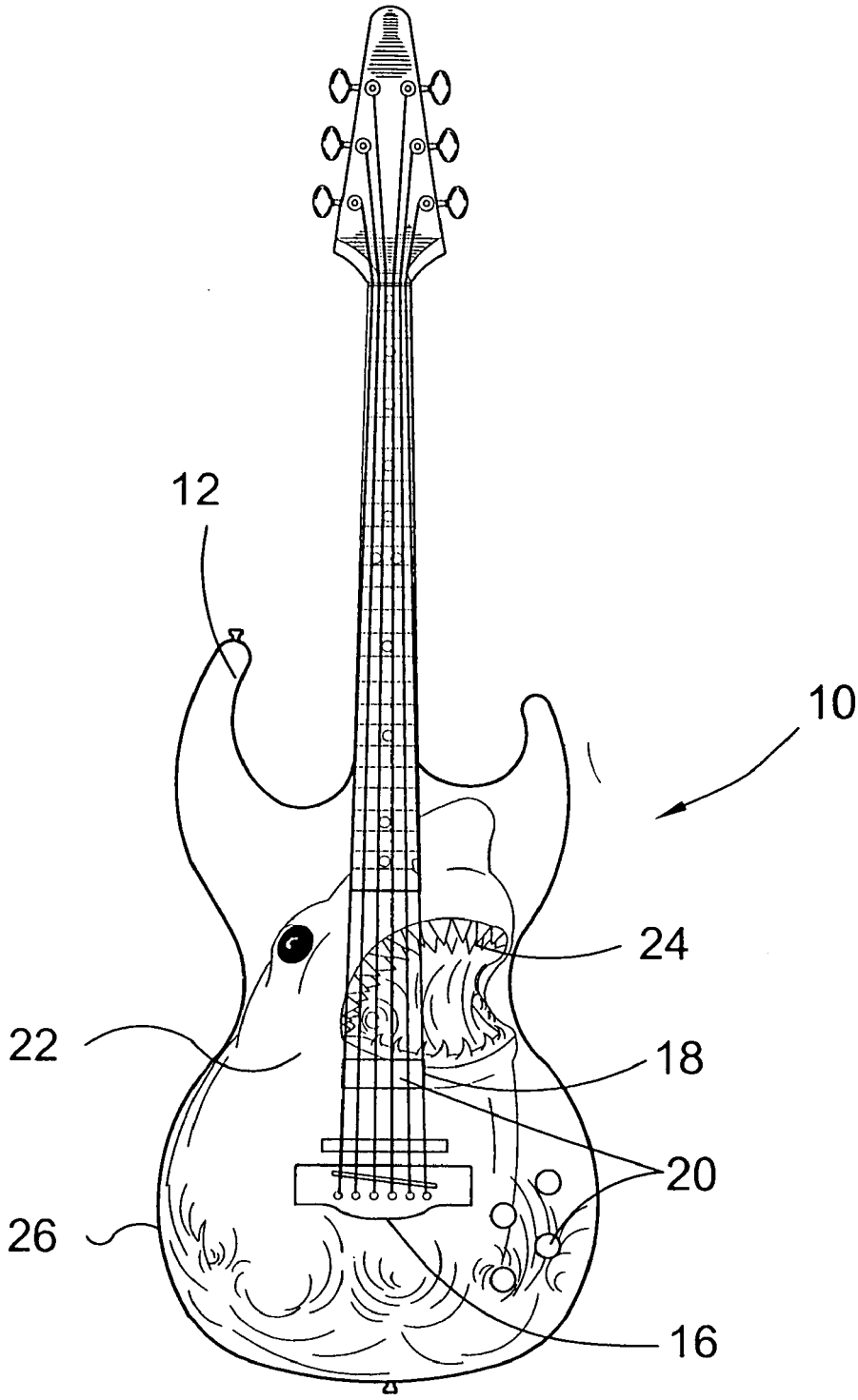
FIG. 2 is a front view of the present invention.

Turning to FIG. 2, shown therein is a front view of the present invention 10. Shown is the lenticular guitar top forming an integral part of a solid body guitar 12. The lenticular or lenticulated top surface 22 is comprised of an array of parallel linear lenses covering images 24 that are formed in such a manner that changing the viewing angle changes the image. The lenticular top 22 is bonded at 26 to the top surface of the guitar body having apertures or cutouts 16, 18, 20 for the placement of guitar hardware.

Figure 3:
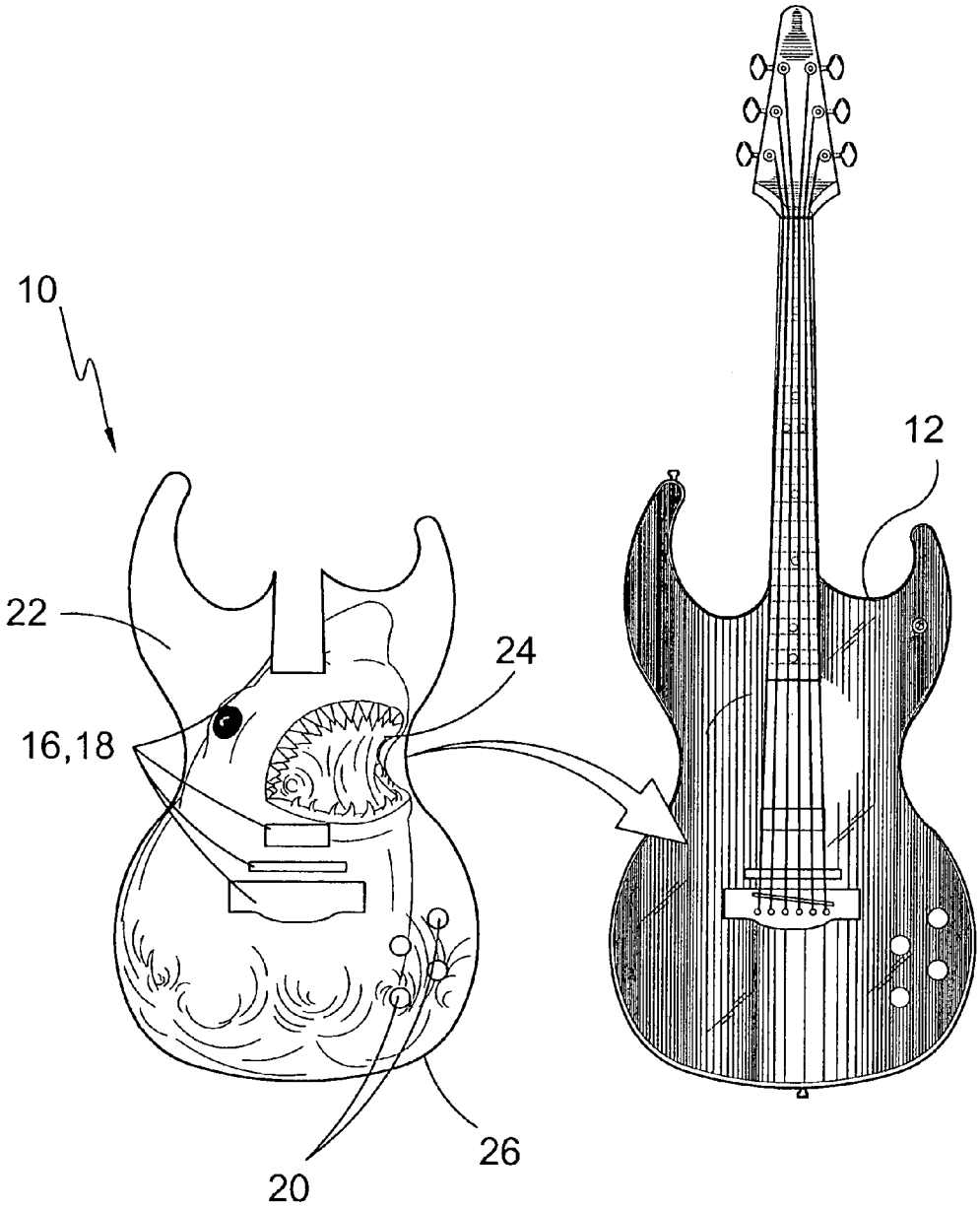
FIG. 3 is an exploded view of the present invention.

Turning to FIG. 3, shown therein is an exploded view of the present invention 10. Shown is the lenticular guitar top 22 formed to the shape of the guitar 12 body having cutouts 16, 18, 20 within the lenticular top for the placement of guitar hardware, such as knobs and bridge. The lenticular 22 is fastened or bonded at 26 to the top surface of a solid body guitar 12 forming an integral part therewith. The lenticular is an array of parallel linear lenses covering images 24 that are formed in such a manner that changing the viewing angle changes the image.

Figure 4:
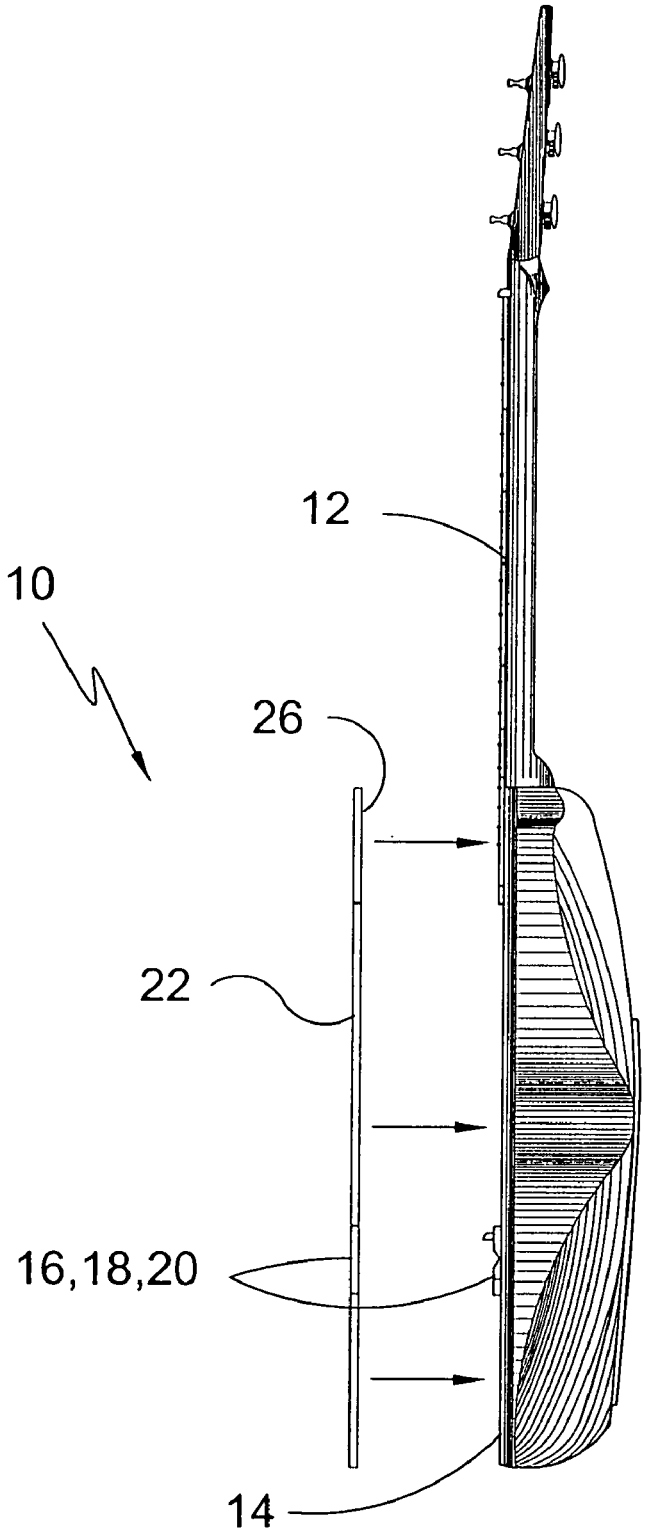
FIG. 4 is a side view of the present invention.

Turning to FIG. 4, shown therein is a side view of the present invention 10. Shown is a side view of a solid body guitar 12 having the lenticular top 22 spaced away from the top surface 14 and ready to be placed thereon forming an integral part of the guitar. Once applied to the body of the guitar 14 the lenticular 22 forms an integral part therewith. The top 22 has one or more apertures 16, 18, 20 whereby components such as control spindles can pass therethrough having knobs positioned thereon after the lenticular is fixedly positioned. Also shown is the permanent adhesive bonding layer 26.

Figure 5:
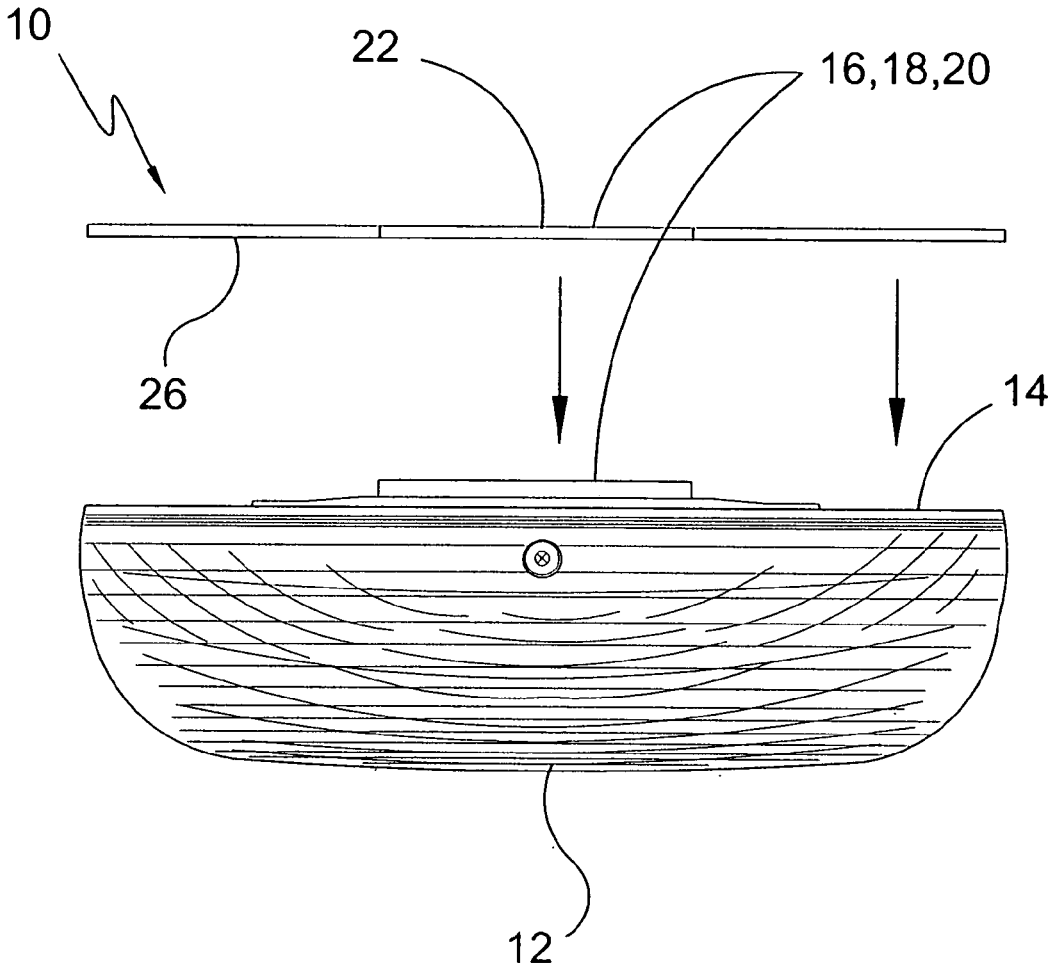
FIG. 5 is an end view of the present invention and solid body guitar.

Turning to FIG. 5, shown therein is an end view of the present invention 10 and solid body guitar 12. Shown is an end view of a solid body guitar 12 having the lenticular 22 spaced away from the top surface 14 and ready to be placed thereon forming an integral part of the guitar. Once applied to the body of the guitar 12 the lenticular 22 forms an integral part therewith. The top 22 has one or more apertures 16, 18, 20 whereby components such as control spindles can pass therethrough having knobs positioned thereon after the lenticular is fixedly positioned. Adhesive layer 26 is also shown.

Figure 6:
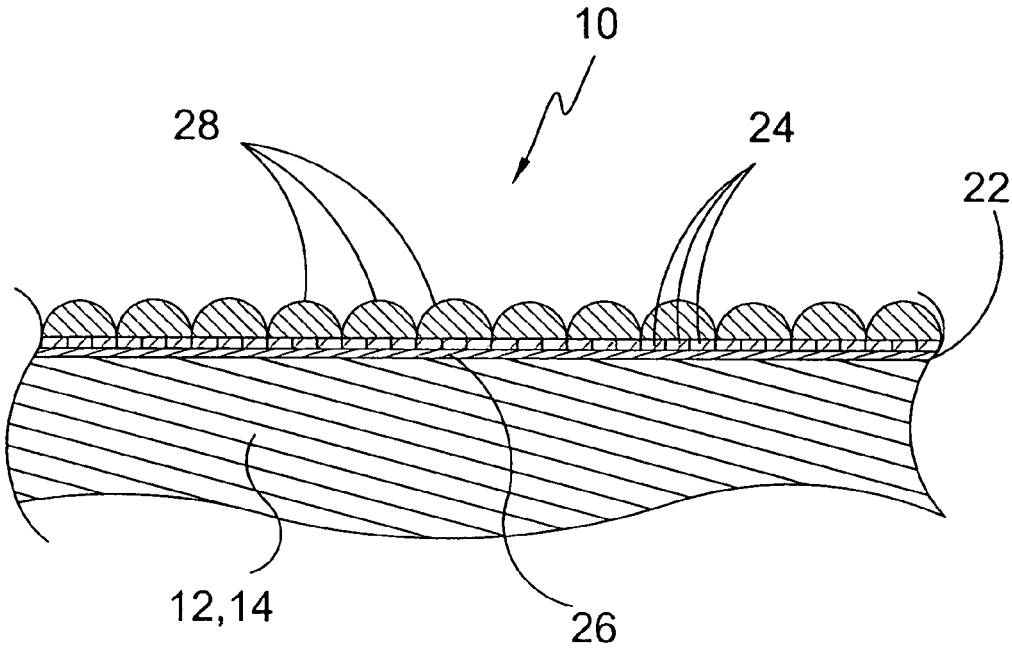
FIG. 6 is a sectional view of the present invention.

Turning too FIG. 6, shown therein is a sectional view of the present invention 10. Shown is a sectional view of a solid body guitar 12 having a lenticular 22 fixedly attached to the top surface 14 forming an integral part therewith. The lenticular is an array of parallel linear lenses 28 covering images 24 that are formed in such a manner that changing the viewing angle changes the image. The lenticular 22 is fastened to the top surface 14 using a bonding agent such as an adhesive and the adhesive layer 26 is shown.

Figure 7:
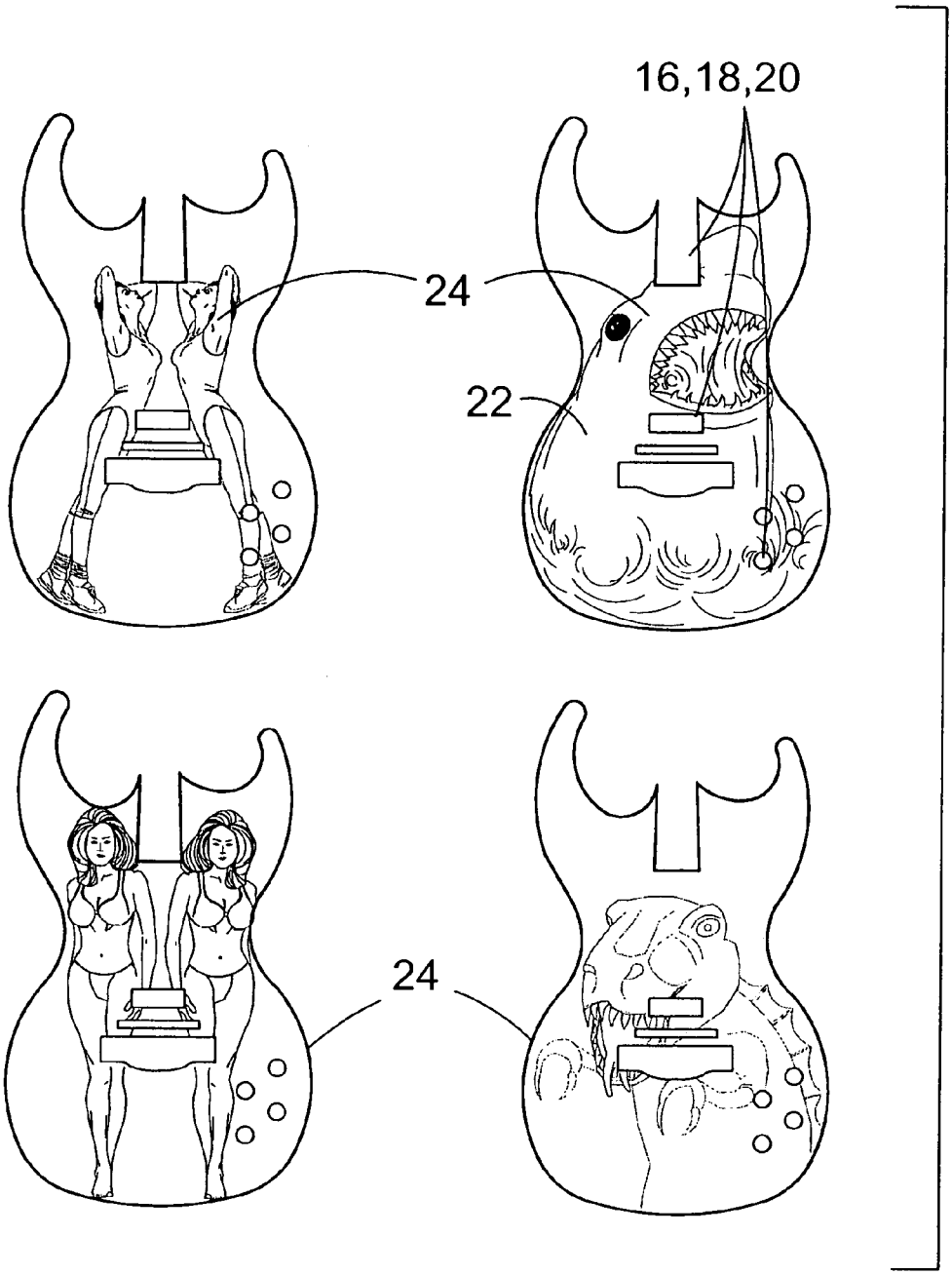
FIG. 7 is frontal views of various alternate designs.

Turning to FIG. 7, shown therein are frontal views of various alternate designs. Shown are possible alternate designs of the image(s) 24 positioned on the underside of the linear lenses. The lenticular 22 formed of juxtapositioned linear lenses is fabricated to conform to the surface area of a solid body guitar top having apertures and cutouts 16, 18, 20 for guitar hardware. The lenticular 22 forms a new and novel aesthetically pleasing fascia for a guitar wherein any image, picture, graphic and/or indicia can be used to create personalized guitar top finishes.

I claim:

1. A top of a stringed instrument for mounting onto the front of a body of the stringed musical instrument, comprising:

a) a rigid top layer of the stringed instrument being disposed on the front of a musical instrument, said top layer having an exterior side and a rear side, wherein said rear side is oriented toward the front of the musical instrument and the top layer is coextensive with the front of the instrument body;

b) a lenticulated surface layer having a plurality of convex lenses formed thereon being disposed on said exterior side of said top layer for creating special visual effects, said lenticulated surface layer being coextensive with said top layer;

c) an image sheet having a plurality of lenticular images created by said lenticulated surface layer to permit the appearance of the musical instrument to be enhanced, the sheet being affixed to the rear side of the lenticulated surface layer and coextensive therewith; and d) a bonding layer being disposed between a rear side of said image sheet and said exterior side of said top layer of said instrument, for permanently bonding said lenticulated surface layer and image sheet to said top layer, whereby said top of said stringed instrument comprises a lamination of said top layer, said image sheet and said lenticulated surface layer.

2. The top of claim 1, wherein said bonding layer comprises an adhesive material.

3. The top of claim 2, wherein said bonding layer comprises glue.

4. The top of claim 2, wherein said top is complementarily shaped as the front of the musical instrument.

5. The top of claim 4, wherein said top has a plurality of apertures therein to permit the guitar hardware to pass through the apertures.

6. The top of claim 5, wherein said musical instrument comprise an electric guitar.

7. The top of claim 5, wherein said musical instrument comprises an electric bass guitar.

8. The top of claim 1 wherein the lenticulated surface layer comprises a plastic sheet and the lenses are formed in parallel rows across the exterior side of the sheet.

9. In a method of forming a top for a body of a stringed instrument, the method comprising the steps of:

a) permanently laminating a rigid top surface material, a lenticular image sheet and a lenticulated surface material together with the lenticulated surface material and said rigid top surface material, lenticular image and lenticulated surface material being shaped and sized so as to be coextensive, wherein said lenticulated surface material has a plurality of convex lenses thereon; and b) bonding the rigid top surface material to the instrument body.

* * * * *